US007789077B2

(12) United States Patent
Igarashi et al.

(10) Patent No.: US 7,789,077 B2
(45) Date of Patent: Sep. 7, 2010

(54) CRANKCASE OF INTERNAL COMBUSTION ENGINE

(75) Inventors: Kazunori Igarashi, Saitama (JP); Makoto Ogasawara, Saitama (JP)

(73) Assignee: Honda Motor Co., Ltd., Tokyo (JP)

( * ) Notice: Subject to any disclaimer, the term of this patent is extended or adjusted under 35 U.S.C. 154(b) by 0 days.

(21) Appl. No.: 11/783,543

(22) Filed: Apr. 10, 2007

(65) Prior Publication Data

US 2007/0245983 A1 Oct. 25, 2007

(30) Foreign Application Priority Data

Apr. 11, 2006 (JP) ..... 2006-108402
May 23, 2006 (JP) ..... 2006-143305

(51) Int. Cl.
*F02B 25/06* (2006.01)

(52) U.S. Cl. ..... 123/572; 123/195 H; 123/196 R; 123/196 W

(58) Field of Classification Search ..... 123/198 E, 123/195 H, 41.33, 41.42, 41.39, 144, 195 HC, 123/197.1, 41.56, 657, 188.4, 196 R, 196 W; 384/429; 92/71; 74/58, 57, 55, 569, 579 E; 184/11.1, 1.5, 6.26; *F02B 25/06*
See application file for complete search history.

(56) References Cited

U.S. PATENT DOCUMENTS 3,521,613 A * 7/1970 Celli ..... 123/195 R
3,754,538 A * 8/1973 Ephraim et al. ..... 123/41.86
3,973,548 A * 8/1976 Celli ..... 123/195 R
4,501,234 A * 2/1985 Toki et al. ..... 123/41.86
4,924,818 A * 5/1990 Linden ..... 123/41.14
4,964,378 A * 10/1990 Tamba et al. ..... 123/41.57
5,522,351 A * 6/1996 Hudson ..... 123/41.33
6,125,811 A * 10/2000 Koriyama et al. ..... 123/195 R
6,196,206 B1 * 3/2001 Bedkowski ..... 123/572
6,543,405 B2 * 4/2003 Sachdev et al. ..... 123/195 R

FOREIGN PATENT DOCUMENTS

JP 2004-218502 A 8/2004
JP 2004-245176 A 9/2004

* cited by examiner

*Primary Examiner*—Stephen K Cronin
*Assistant Examiner*—Keith Coleman
(74) *Attorney, Agent, or Firm*—Birch, Stewart, Kolasch & Birch, LLP

(57) ABSTRACT

To prevent dew condensation in a crankcase in a lower part of the crankcase, wherein an oil pan is an integral part of an internal combustion engine, to prevent lubricating oil from being diluted. A crankcase cover covers at least an oil pan out of a crankcase and is provided to the bottom of the crankcase. A heat insulating material is provided between the crankcase and the crankcase cover. A cooling fluid passage for providing a circulation to cool a cylinder or a cylinder head is provided between the crankcase and the crankcase cover. A passage at least one end of which reaches a cylinder head from a crankcase via a cylinder block forms at least a part of a blowby gas passage, is directly provided to the crankcase, the cylinder block and the cylinder head. A flow control valve is arranged in the cylinder block or the cylinder head.

11 Claims, 8 Drawing Sheets

CRANKCASE OF INTERNAL COMBUSTION ENGINE

CROSS-REFERENCE TO RELATED APPLICATIONS

The present application claims priority under 35 USC 119 to Japanese Patent Application Nos. 2006-108402 filed on Apr. 11, 2006 and 2006-143305 filed on May 23, 2006 the entire contents of which are hereby incorporated by reference.

BACKGROUND OF THE INVENTION

1. Field of the Invention

The present invention relates to the structure of a crankcase for an internal combustion engine. More specifically, to the structure of a crankcase for preventing dew condensation in the crankcase and preventing lubricating oil from being diluted by the inflow of condensed dew. In addition, the present invention relates to a crankcase emission control system of an internal combustion engine wherein a flow control valve that allows only a flow to the side of an intake system is provided on the way of a blowby gas passage connecting the intake system including an intake port provided to a cylinder head and a crankcase.

2. Description of Background Art

As difference in temperature between blowby gas that leaks out into a crankcase and the crankcase or lubricating oil is large when warming up is made in a situation where outside air temperature is low, steam and hydrocarbon included in the blowby gas are condensed into a dew in the crankcase. This dew is mixed with the lubricating oil and may dilute the lubricating oil. In operating the vehicle at the beginning of driving in a situation where outside air temperature is low, dew condensation and the dilution of lubricating oil may be also caused.

In JP-A No. 2004-218502 (FIG. 3), a technique is disclosed for heating cooling water for cooling an internal combustion engine when the internal combustion engine is started, for heating lubricating oil by the cooling water and for reducing the time for warming up. In this technique, the cooling water is made to flow into a cooling water passage for controlling the temperature of the lubricating oil is led into a heater passage and is heated there, and hereby, the lubricating oil is warmed.

In the related art, as cooling water is led into a heater passage and is heated there to heat the cooling water, a heater is required to be provided and the structure is complex.

In an internal combustion engine, a part of exhaust gas combusted in a combustion chamber leaks to the side of a crankcase from a clearance between an inside face of a cylinder bore and a piston as blowby gas. Thereafter, it is practical to use a technique for taking fresh air from an intake system into the crankcase, circulating blowby gas in the crankcase to the intake system and recombusting it in the combustion chamber.

As the performance of the engine is deteriorated when the quantity in which blowby gas is increased recklessly when it is circulated, a flow control valve that regulates the circulation of the quantity is provided on the way of a blowby gas passage. See, for example, JP-A No. 2004-245176.

However, the flow control valve disclosed in JP-A No. 2004-245176 is connected to an outlet of an oil separator provided to a crankcase and a cylinder head in the body of the engine that is attached to the outside face of a cylinder block and is connected on the way of an intake pipe connecting an air cleaner and an intake port via a hose. As the blowby gas passage from the crankcase to the intake pipe is long, the temperature of the blowby gas in the blowby gas passage is lowered and dew condensation may be caused.

SUMMARY AND OBJECTS OF THE INVENTION

An object of an embodiment of the present invention is to prevent lubricating oil from being diluted by insulating the heat of the lubricating oil or by heating the lubricating oil with a simple structure.

In the present invention, "dew condensation" is used not only in a case where moist gas is touched to the surface of a cold solid and is liquidized but in a case where moist gas is touched to the surface of a cold liquid and is liquidized.

An object of an embodiment of the present invention is to address the problem relating to a crankcase of an internal combustion engine provided with a crankcase cover that covers at least an oil pan out of the crankcase that is provided at the bottom of the crankcase in the crankcase with a lower part of which the oil pan is integrated with the internal combustion engine.

An object of an embodiment of the present invention the heat insulating material is provided between the crankcase and the crankcase cover in the crankcase of the internal combustion engine.

An object of an embodiment of the present invention a cooling water passage for making cooling water circulated to cool a cylinder or a cylinder head flow is provided between the crankcase and the crankcase cover in the crankcase of the internal combustion engine.

An object of an embodiment of the present invention a crankcase of an internal combustion engine is provided with a crankcase that has a double wall structure and space between its double walls functions as a cooling water passage for making cooling water circulated to cool a cylinder or a cylinder head flow in the crankcase with a lower part of which an oil pan is integrated with the internal combustion engine.

An object of an embodiment of the present invention is to provide the double wall structure so that the structure surrounds the oil pan in the crankcase of the internal combustion engine.

An object of an embodiment of the present invention a cooling water pump is provided to the side of the crankcase to which the cooling water passage is provided in the crankcase of the internal combustion engine.

According to an object of an embodiment of the present invention, an area where the oil pan is touched to outside air or an air flow during operation of the vehicle is reduced by providing the crankcase cover that covers at least the oil pan to the bottom of the crankcase. Thus, the cooling of the lubricating oil is prevented. When the cooling of the lubricating oil is prevented, a difference in temperature between the lubricating oil and the blowby gas is reduced and the effect of preventing dew condensation is produced.

According an object of an embodiment of the present invention, outside air temperature and an air flow further hardly have an effect and dew condensation can be prevented.

According to an object of an embodiment of the present invention, as the crankcase is warmed by cooling water which is circulated in the cylinder and the temperature of the cylinder head is raised in warming up, dew condensation in the crankcase is soon prevented. In addition, the temperature of lubricating oil is raised by heat exchange between the cooling water and the lubricating oil in the crankcase and the lubricating oil can be prevented from being diluted. More particularly, in the oil pan, the heat exchange with the lubricating oil is accelerated and is useful for preventing dew condensation. After warming up is finished, the cooling water passage provided to the oil pan can play the role of an oil cooler if the water is made to flow via a radiator.

According to an object of an embodiment of the present invention, the rigidity of the crankcase is enhanced, vibration and noise are reduced, space between the double walls is effectively utilized and a heat exchange between lubricating oil and cooling water is made. Thus, dew condensation can be prevented. After warming up is finished, the cooling water passage provided to the oil pan can play the role of an oil cooler if the water is made to flow via a radiator.

According to an object of an embodiment of the present invention, as the cover is provided to cover the oil pan, the area of a heat exchange between the cooling water passage and the oil pan can be increased, compared with a case wherein the cover covers a part of the oil pan and the effect of preventing dew condensation can be enhanced.

According to an object of an embodiment of the present invention, as the double walls of the oil pan functions as a cooling water passage and the cooling water pump is provided to the side of the crankcase cover, a piping layout is facilitated, the length of the piping can be reduced, and cooling water can be smoothly circulated.

An embodiment of the present invention is made in view of such a situation wherein a crankcase emission control system of an internal combustion engine is provided where a blowby gas passage is shortened and the generation of dew condensation in the blowby gas passage can be inhibited.

To achieve the object, according to an embodiment of the present invention a passage at least a part of which reaches a cylinder head from a crankcase via a cylinder block forms at least a part of the blowby gas passage, is directly provided to the crankcase with the cylinder block and the cylinder head and a flow control valve being arranged in the cylinder block or the cylinder head on the way of the passage in a crankcase emission control system of the internal combustion engine. The flow control valve that allows only a flow to the side of an intake system is provided on the way of the blowby gas passage connecting the intake system that including an intake port provided to the cylinder head and the crankcase.

According to an embodiment of the present invention, the flow control valve is arranged in the cylinder head in a state in which its outlet is directly open to the intake port.

Further, according to an embodiment of the present invention a vapor-liquid separating chamber acquired by expanding the area of the passage is formed in the cylinder block on the way of the passage on the side of not the flow control valve but the crankcase.

According to an embodiment of the present invention, the length of the blowby gas passage from the crankcase to the intake system can be shortened, the temperature of blowby gas that flows in the blowby gas passage is prevented from being lowered, and the generation of dew condensation can be inhibited. More particularly, as blowby gas that flows in the blowby gas passage can easily receive heat generated in the body of the engine, the effect of preventing dew condensation can be more enhanced.

According to an embodiment of the present invention, the blowby gas passage is connected to the intake port by only connecting the blowby gas passage provided to the crankcase and the cylinder block to the flow control valve mounted on the cylinder head. Thus, not only assembling work is facilitated but a compact layout is enabled.

Further, according to an embodiment of the present invention, the separation of oil from blowby gas can be accelerated in the vapor-liquid separating chamber that receives heat from the cylinder block and vapor-liquid separation before blowby gas reaches the flow control valve is enabled. In addition, space for arranging the flow control valve in the cylinder block is not required to be secured in a state in which the flow control valve is arranged in the cylinder head and the volume of the vapor-liquid separating chamber can be increased.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 1:
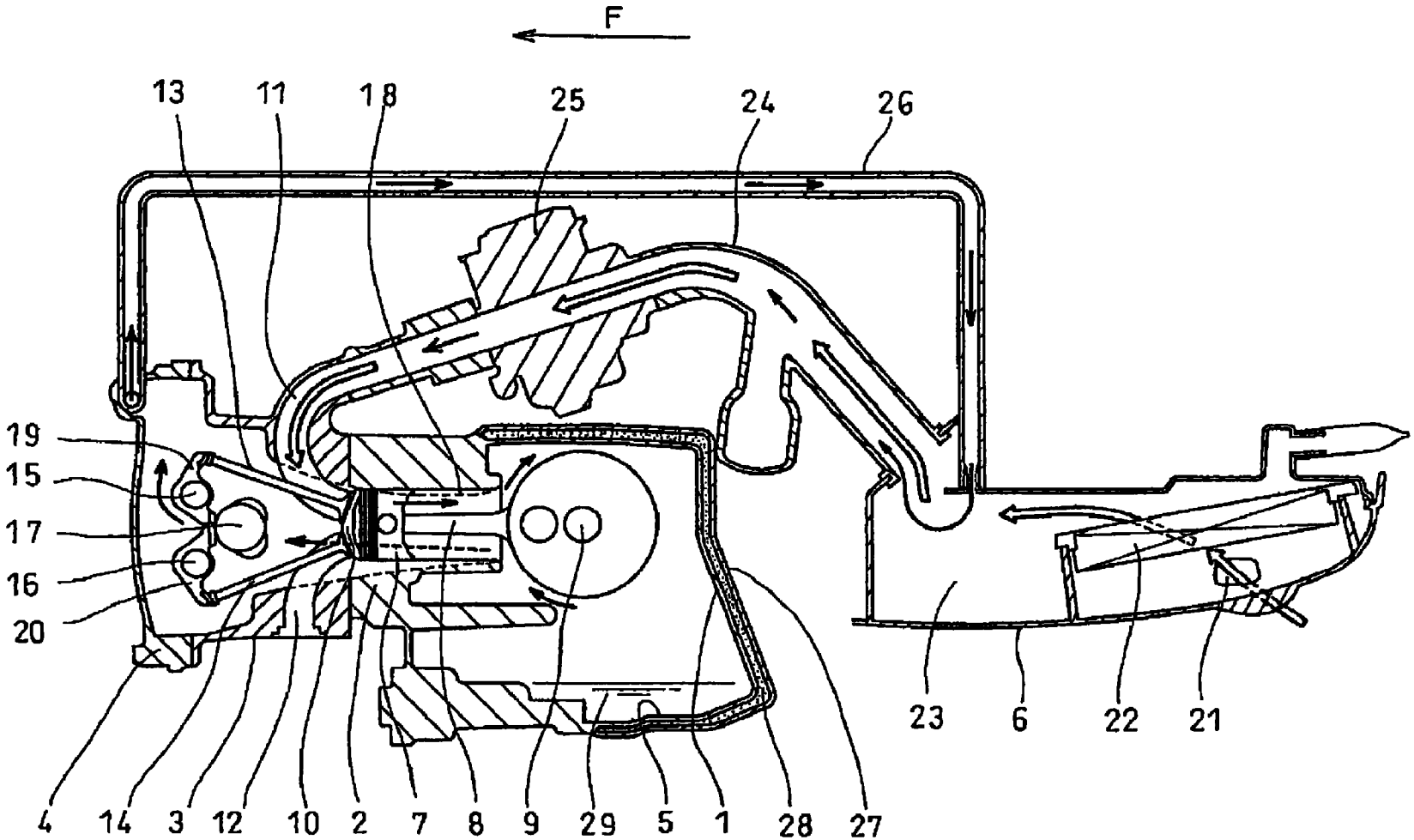
FIG. 1 is a sectional view viewed from the left side showing a main part of an internal combustion engine equivalent to a first embodiment of the present invention.

FIG. 1 is a sectional view showing a main part of a wet sump lubrication type 4-stroke cycle internal combustion engine equivalent to a first embodiment of the present invention from the left side and an arrow F points to the front of the internal combustion engine. In FIG. 1, the internal combustion engine is configured by a crankcase 1, a cylinder 2 integrated with the crankcase 1, a cylinder head 3, a head cover 4, an oil pan 5 in a lower part of the crankcase and an air cleaner 6. A piston 7 is slidably housed in the cylinder 2 and is connected to a crankshaft 9 via a connecting rod 8.

A combustion chamber 10 is provided on the side of the piston 7 in the cylinder head 3. An intake port 11 and an exhaust port 12 are provided to the cylinder head 3 and respective inner ends are open to the combustion chamber 10. An intake valve 13 and an exhaust valve 14 for opening and closing respective openings are provided to the openings at the respective inner ends of the intake port 11 and the exhaust port 12.

An intake rocker arm shaft 15, an exhaust rocker arm shaft 16 and a camshaft 17 are provided to the vicinity of a boundary of respective internal spaces of the cylinder head 3 and the head cover 4. A cam chain chamber 18 is provided on the side of the cylinder, a cam chain (not shown) driven by the crankshaft 9 is housed there, and the cam chain drives the camshaft 17. The intake valve 13 and the exhaust valve 14 are opened and closed via the intake rocker arm 19 and the exhaust rocker arm 20 by a cam formed on the camshaft 17.

The air cleaner 6 is provided at the back of the head cover 4. The air cleaner 6 is provided with an air intake port 21 and a filter 22, and a clean air chamber 23 is provided on the downstream side of the filter 22. The clean air chamber 23 and the intake port 11 are coupled via an intake pipe 24. A carburetor 25 is provided on the way of the intake pipe 24. The internal space of the head cover 4 and the clean air chamber 23 of the air cleaner 6 are coupled by a crankcase emission control pipe 26.

In the internal combustion engine, steam, unburned gas, combusted gas and others leak out into the crankcase 1 as blowby gas due to pressure generated in the combustion chamber 10. The inside of the crankcase is pressurized and decompressed as the piston is lowered and lifted. When the inside of the crankcase is pressurized, blowby gas in the crankcase is delivered into the clean air chamber 23 via the cam chain chamber 18, respective internal space of the cylinder head 3 and the head cover 4 and the crankcase emission control pipe 26 in order, is delivered into the intake pipe 24 together with clean air, after the blowby gas is mixed with fuel in the carburetor 25 on the way, it is delivered into the combustion chamber 10 via the intake port 11, and is used for combustion. When the inside of the crankcase is decompressed, clean air is supplied into the crankcase 1 from the clean air chamber 23 in the reverse order of a crankcase emission control path described above. In FIG. 1, an arrow shown by a full line shows a flow of blowby gas and an arrow having a void inside shows a flow of air.

As a difference between outside air temperature and temperature in the crankcase is large when warming up is made in a situation wherein the outside air temperature is low, steam and hydrocarbon included in the blowby gas leaked out into the crankcase are condensed into a dew in the crankcase cooled from the outside to be turned at low temperature and flow down, steam and hydrocarbon are touched to lubricating oil 29 cooled from the outside to be turned at a low temperature in the oil pan 5 in the lower part of the crankcase and are liquidized and these dilute the lubricating oil 29 in the oil pan 5. In operating the vehicle at the beginning of driving in the situation wherein the outside air temperature is low, dew condensation and the dilution of lubricating oil are also caused.

In this embodiment, to prevent the crankcase from being cooled from the outside described above, a crankcase cover 27 is provided to the periphery of the crankcase 1. Hereby, the crankcase is hardly influenced by outside air temperature and an air flow during operation, and dew condensation in the crankcase and the cooling of lubricating oil 29 are prevented. In addition, if the space between the crankcase 1 and the crankcase cover 27 is filled with heat insulating material 28 as shown in FIG. 1, it is more effective to prevent dew condensation in the crankcase 1 and the cooling of lubricating oil.

Figure 2:
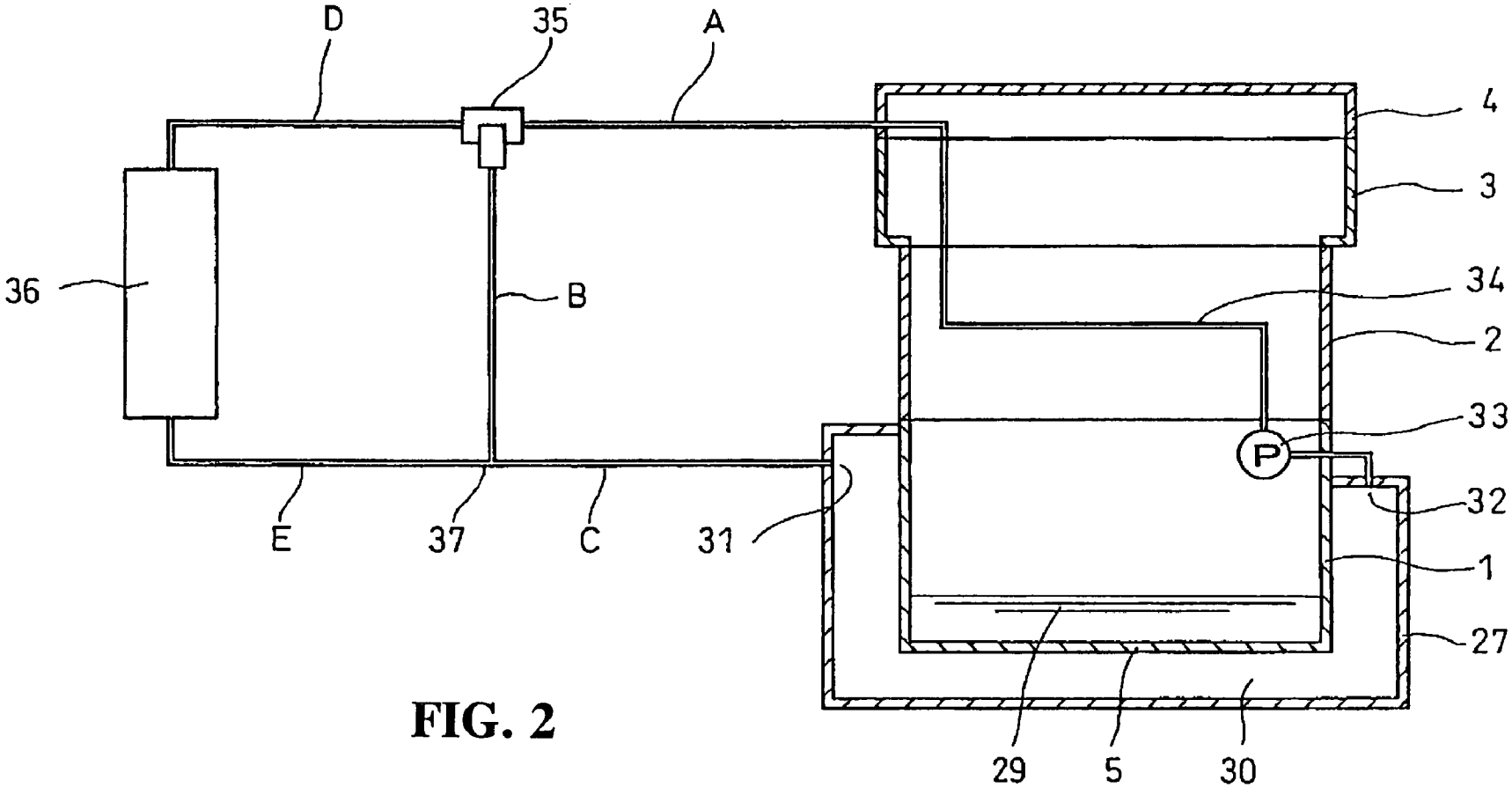
FIG. 2 is a system diagram showing a main part of an internal combustion engine equivalent to a second embodiment of the present invention.

FIG. 2 is a system diagram showing a main part of an internal combustion engine equivalent to a second embodiment of the present invention. The same reference numerals are allocated to the same members as that in the first embodiment. The internal combustion engine is configured by a crankcase 1, a cylinder 2, a cylinder head 3, a head cover 4, an oil pan 5 and a crankcase cover 27 that covers the periphery of the crankcase 1. Lubricating oil 29 is stored in the oil pan 5. In this embodiment, a part between the crankcase 1 and the crankcase cover 27 functions as a crankcase cooling water passage 30 for making cooling water circulated to cool the cylinder 2 or the cylinder head 3 flow. A cooling water inlet 31 and a cooling water outlet 32 are provided on the reverse sides of the upside. A water pump 33 for circulating the cooling water is connected to the cooling water outlet 32. In the internal combustion engine, to cool the cylinder 2 and the cylinder head 3 which are operated at a high temperature during driving, a cylinder cooling water passage 34 is provided to the vicinity of these members.

When the internal combustion engine is warmed up, water that flows out of the cooling water outlet 32 of the crankcase cooling water passage 30 is pressurized by the water pump 33, passes the cylinder cooling water passage 34 wherein the temperature of the water is raised. The water is then returned to the cooling water inlet 31 of the cooling water passage 30 through a piping A, a thermostat 35, a piping B and a piping C, and is circulated.

As the temperature of the crankcase and the oil pan are not required to be raised in the normal operation of the internal combustion engine, water that flows out of the cooling water outlet 32 is pumped by the water pump 33, after the water passes the cylinder cooling water passage 34, it is cooled through the piping A, the thermostat 35, a piping D and a radiator 36, is afterward returned to the cooling water inlet 31 via a piping E and the piping C, and is circulated.

The thermostat 35 senses the temperature of cooling water and controls a direction of a water flow. When the temperature of cooling water is low at the beginning of driving, water, the temperature of which is raised in a course of the cylinder cooling water passage 34, is made to flow toward the pipings B, C and is delivered into the crankcase cooling water passage 30 in a state in which the temperature is high. As the crankcase and lubricating oil are rapidly warmed by the water the temperature of which is raised at the beginning of driving, blowby gas is prevented from being condensed into a dew in the crankcase, and condensed moisture and unburned gas are prevented from diluting the lubricating oil in the oil pan. Blowby gas in the crankcase is prevented from being touched to cold lubricating oil 29 in the oil pan and being liquidized, from being mixed with the lubricating oil and diluting the lubricating oil.

When it is sensed by the thermostat 35 that the temperature of water is sufficiently high, a flowing path is changed, after water that passes the cylinder cooling water passage 34 passes the piping A and the thermostat 35, it passes the piping D and is cooled in the radiator 36, and is delivered into the cooling water inlet via the pipings E, C. The piping E is connected to a connection 37 of the pipings B, C. As water which passes the cylinder cooling water passage 34 and the temperature of which is raised is delivered into the crankcase cooling water passage 30 after the water is cooled in the radiator 36, the crankcase cooling water passage functions as an oil cooler and can prevent the excessive rise of the temperature of the oil.

In the second embodiment, the crankcase cover 27 is separate from the periphery of the crankcase 1 and the cooling water passage is provided between the crankcase and the crankcase cover is described. However, in a third embodiment that will be described next, the space between double walls of a crankcase produced beforehand so that the periphery of an oil pan has a double wall structure to prevent vibration and noise from a crankcase or to enhance the rigidity of the crankcase is utilized for a crankcase cooling water passage and the structure is utilized for heating the crankcase and lubricating oil when driving is started will be described.

Figure 3:
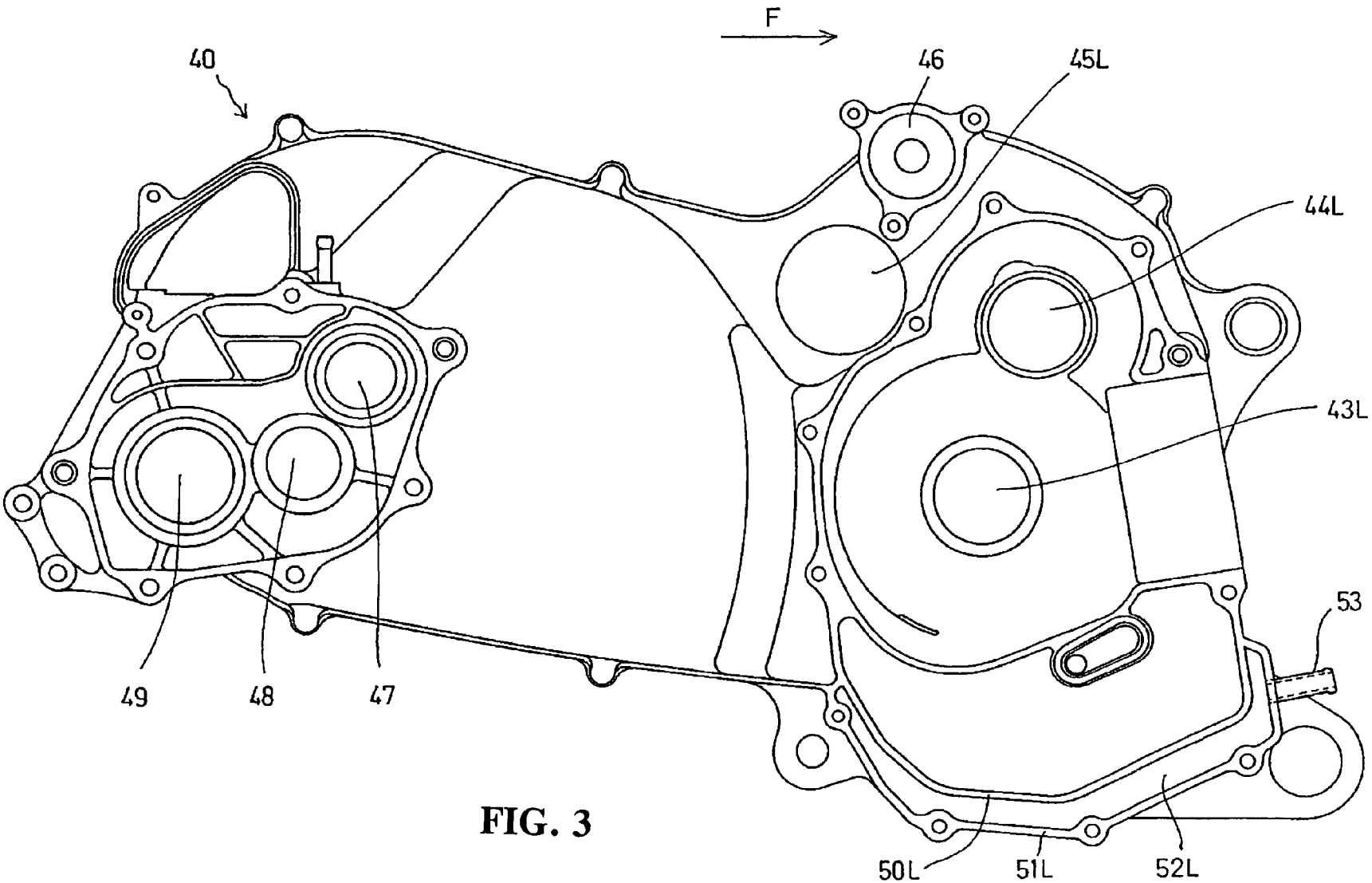
FIG. 3 is a right side view showing a left crankcase in a third embodiment of the present invention.
Figure 4:
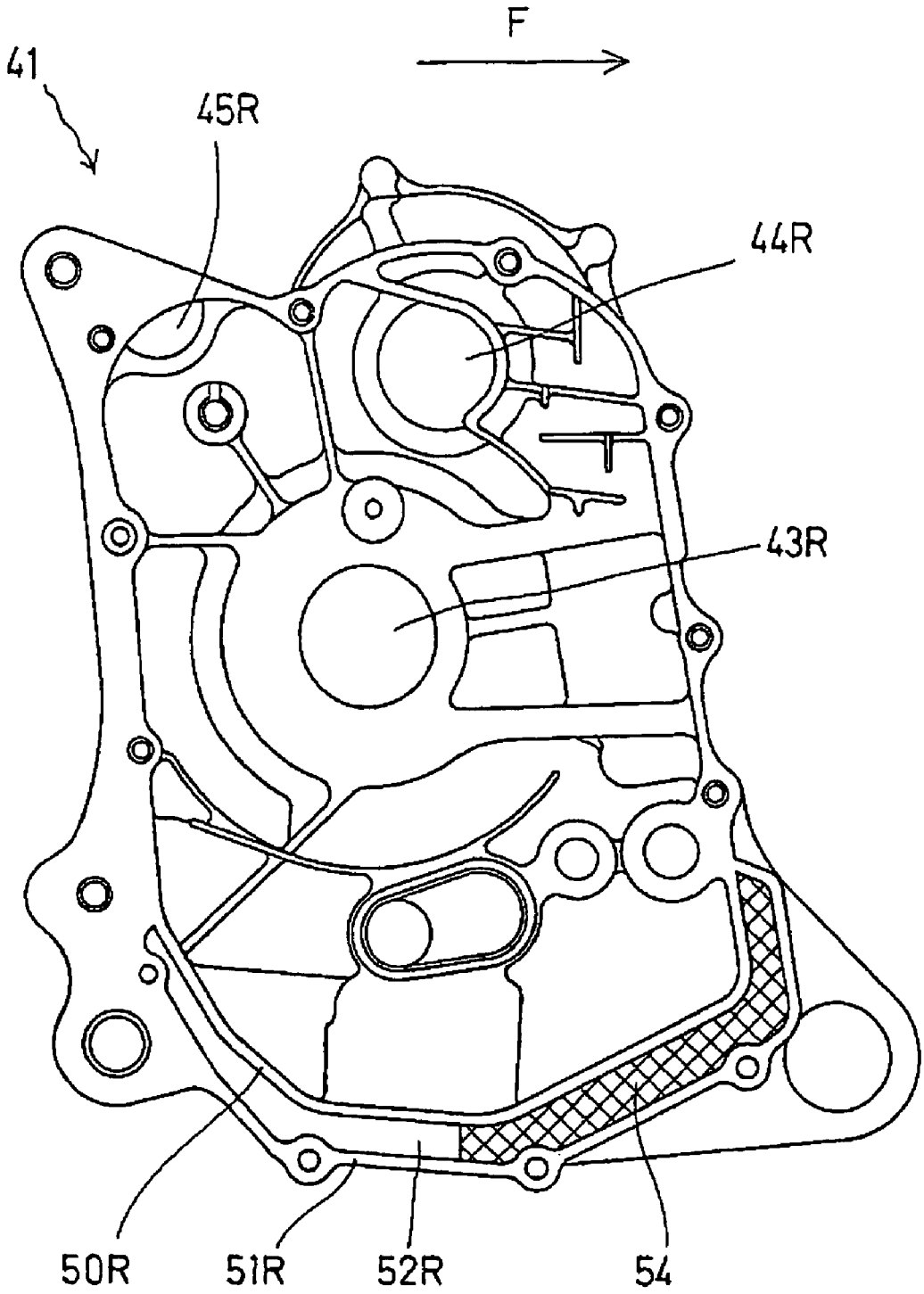
FIG. 4 is a right side view showing a right crankcase in the third embodiment of the present invention.
Figure 5:
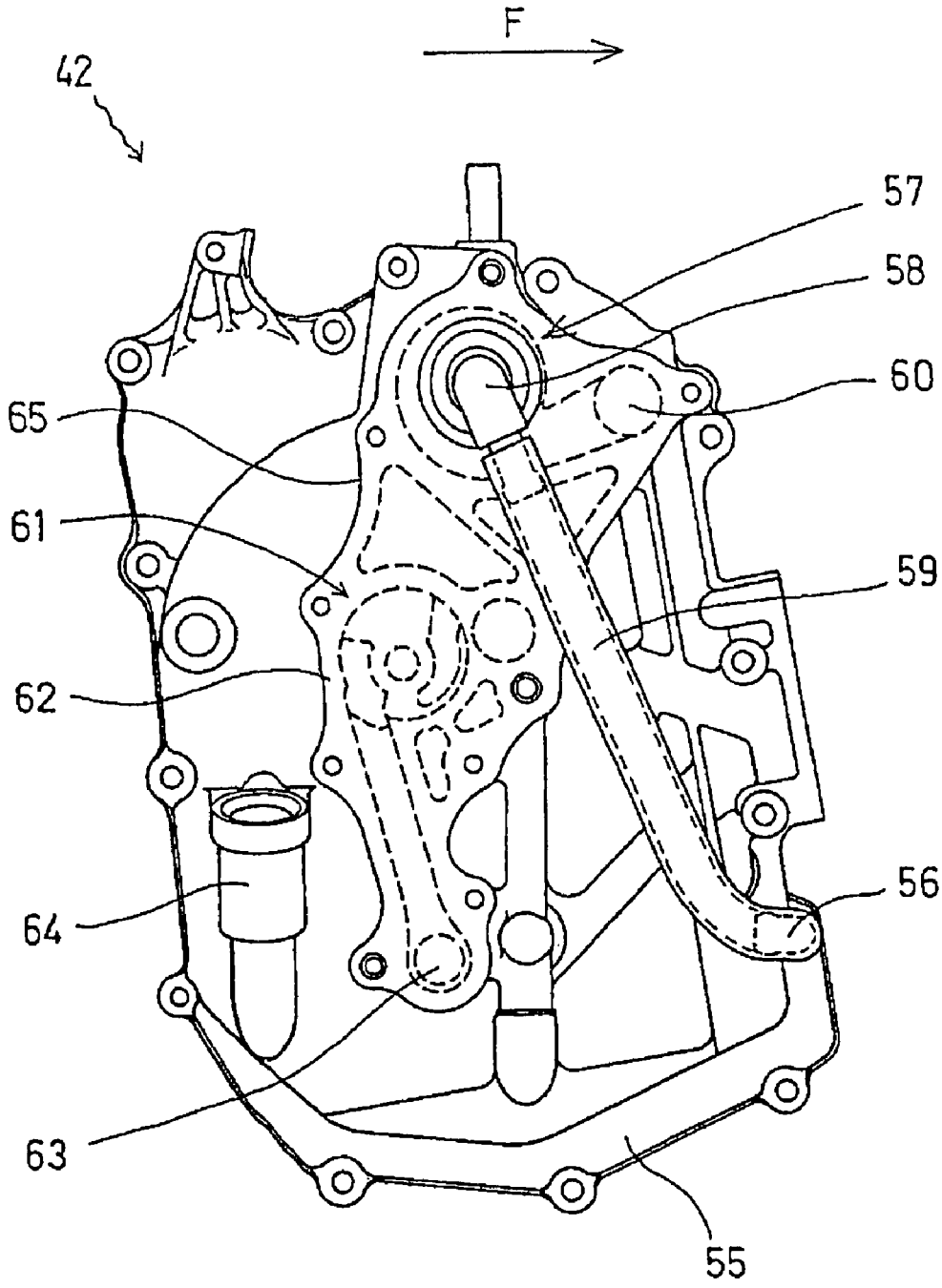
FIG. 5 is a right side view showing a right crankcase cover in the third embodiment of the present invention.

FIGS. 3 to 5 are related to the third embodiment of the invention and show the crankcase and the crankcase cover of a power unit provided with an internal combustion engine integrated with a V-belt continuously variable transmission to which the present invention is applied. The power unit is mounted in the rear of a scooter-type motorcycle so that the power unit can be vertically rocked, and the internal combustion engine, a transmission system, a rear wheel support and a rear wheel which is a driving wheel are integrated. The internal combustion engine is an overhead-valve 4-stroke cycle single-cylinder water-cooled internal combustion engine.

FIG. 3 is a right side view showing a left crankcase 40, FIG. 4 is a right side view showing a right crankcase 41, and FIG. 5 is a right side view showing a right crankcase cover 42 (that covers the right side of the right crankcase 41). In FIGS. 3-5, an arrow F points to the front. The V-belt continuously variable transmission is not shown, however, it is mounted between the left crankcase 40 and a left crankcase cover not shown (that covers the left side of the left crankcase).

FIG. 3 is the right side view showing the left crankcase 40. The front of the left crankcase 40 and the right crankcase 41 described later are connected and form one crankcase. A pair of right and left parts are connected to be one part. In such a case, "L" is a part of the left crankcase and "R" is a part of the right crankcase.

As shown in FIG. 3, in the front of the left crankcase 40, a hole 43L for inserting a crankshaft and a driving pulley shaft, a primary balance shaft insertion hole 44L, an electric motor mounting part 45L for driving a driving pulley movable half and a starter motor mounting part 46 are provided. In the rear of the left crankcase 40, a hole 47 for inserting a driven pulley shaft, a hole 48 for inserting an intermediate shaft for the output and a hole 49 for inserting a rear axle are provided. A lower part of the front of the left crankcase 40 is equivalent to an oil pan 50L and lubricating oil is stored therein. In this power unit, to prevent vibration and noise from the crankcase and to enhance the rigidity of the crankcase, an oil pan cover 51L is provided that is integrally cast with the periphery of the bottom of the oil pan. A double wall structure is formed by the oil pan 50L and the oil pan cover 51L. Space between both walls functions as an oil pan cooling water passage 52L for making cooling water circulated to cool a cylinder or a cylinder head flow. The left side of the passage space is closed and the right side is open. A cooling water inlet 53 is provided at the front end of the cooling water passage 52L.

FIG. 4 is a right side view showing the right crankcase 41. The right crankcase 41 is connected to the right side of the front of the left crankcase 40. A hole 43R for inserting a crankshaft and a driving pulley shaft, a primary balance shaft insertion hole 44R and an electric motor mounting part 45R for driving a driving pulley movable half are provided. An oil pan 50R and an oil pan cover 51R are provided to a lower part of the right crankcase 41 and these are connected to the oil pan 50L and the oil pan cover 51L of the left crankcase 40. The space between the oil pan 50R and the oil pan cover 51R functions as an oil pan cooling water passage 52R. The oil pan cooling water passages 52L, 52R of the left and right crankcases form continuous oil pan cooling water passage space 50. A rear half of the oil pan cooling water passage 52R is pierced laterally. In a front half of the cooling water passage 52R, a partition plate 54 is provided that is close to the left side. This partition plate divides the front half of the cooling water passage space 52 in which the left and right cooling water passages are integrated in two laterally. The right side of the front half of the cooling water passage 52R is open.

FIG. 5 is a right side view showing the right crankcase cover 42. The right crankcase cover 42 covers the right side of the right crankcase 41. A water pump 57 is provided to an upper part of the right crankcase cover 42. An oil pump 61 is formed in the center of the right crankcase cover 42. A common pump cover 65 covers the water pump 57 and the oil pump 61. A water intake port 58 is provided to the outside face of the pump cover 65 corresponding to the center of the water pump 57. A water discharge port 60 is provided close to the water pump.

A lower part of the right crankcase cover 42 covers an open part on the right side of the oil pan cooling water passage 52R of the right crankcase 41 and functions as a right wall 55 of the cooling water passage space 52. A water outlet 56 opposite to the water pump is provided to the front end of the cooling water passage. Water injected from the cooling water inlet 53 at the front end of the left crankcase shown in FIG. 3 flows rearwardly on the left side of the partition plate 54 shown in FIG. 4, reaches a rear half of the cooling water passage space 52, makes a U-turn there and flows forward on the right side of the partition plate 54, and flows out of the water outlet 56 shown in FIG. 5. Water in the cooling water passage space 52 is delivered to the water pump 57 via a rubber hose 59 connecting the water outlet 56 and the water intake port 58 on the outside face of the pump cover 65 and is delivered into the cylinder cooling water passage on the periphery of the cylinder from the water discharge port 60.

A path for circulating cooling water in this embodiment is similar to the path shown in FIG. 2. Water which is discharged from the water discharge port 60 of the water pump, which is circulated in the cylinder and the cylinder head and the temperature of which is raised enters the oil pan cooling water passage 52L from the water inlet 53 of the left crankcase 40 shown in FIG. 3 through the piping A, the thermostat 35, the piping B and the piping C respectively shown in FIG. 2. In warming up, lubricating oil in the oil pan is heated. As a difference between the temperature of blowby gas and that of the lubricating oil decreases when the temperature of the lubricating oil is raised, dew condensation is not caused in the crankcase. In addition, as resistance by the viscosity of the lubricating oil decreases when the temperature of the lubricating oil is raised, the time for warming up can be reduced. When it is sensed by the thermostat 35 that the temperature of the lubricating oil is sufficiently raised, water enters the oil pan cooling water passage from the water inlet 53 of the left crankcase 40 shown in FIG. 3 through the piping A, the thermostat 35, the piping D, the radiator 36, the piping E and the piping C respectively shown in FIG. 2 and cools the lubricating oil the temperature of which is raised in the oil pan.

An oil pump body case 62 is formed on the outside face of the center of the right crankcase cover 42 and the pump cover 65 covers its outside face. The oil pump 61 driven by the crankshaft is formed between the body case 62 and the pump cover 65. An oil intake port 63 is provided to a lower part of the oil pump body case 62, oil in the oil pan is sucked up, and is supplied to a location requiring lubrication of the internal combustion engine. An oil level gauge 64 is provided close to the oil pump 61.

In the above-mentioned embodiments, the following effect is produced.

In the first embodiment, the cooling of lubricating oil is prevented by providing the crankcase cover that covers at least the oil pan to the bottom of the crankcase. As a result, a difference in temperature between blowby gas and the lubricating oil decreases and dew condensation can be prevented.

(2) The effect of outside air temperature and air flow during operation of the vehicle is further removed and dew condensation can be prevented.

(3) In the second embodiment, as the crankcase is warmed by cooling water which is circulated in the cylinder and the cylinder head and the temperature of which is raised in warming up, dew condensation in the crankcase is more quickly prevented. After the warming up is finished, the oil pan cooling water passage functions as an oil cooler if the water is made to flow via the radiator.

(4) In the third embodiment, the rigidity of the crankcase is enhanced, vibration and noise are reduced, space between the double walls is effectively utilized and a heat exchange between lubricating oil and cooling water is made there. Thus, the dew condensation can be prevented. After warming up is finished, the oil pan cooling water passage can play the role of an oil cooler if the water is made to flow via the radiator.

(5) As the oil pan cover is provided to cover the oil pan, the area of a heat exchange between the cooling water passage and the oil pan can be increased, compared with a case wherein a part of the oil pan is covered and the effect of preventing dew condensation can be enhanced.

(6) As space between the double walls of the oil pan functions as the cooling water passage and the cooling water pump is provided to the side of the crankcase cover, the piping layout is facilitated, the length of the pining can be reduced, and cooling water can be smoothly circulated.

Figure 6:
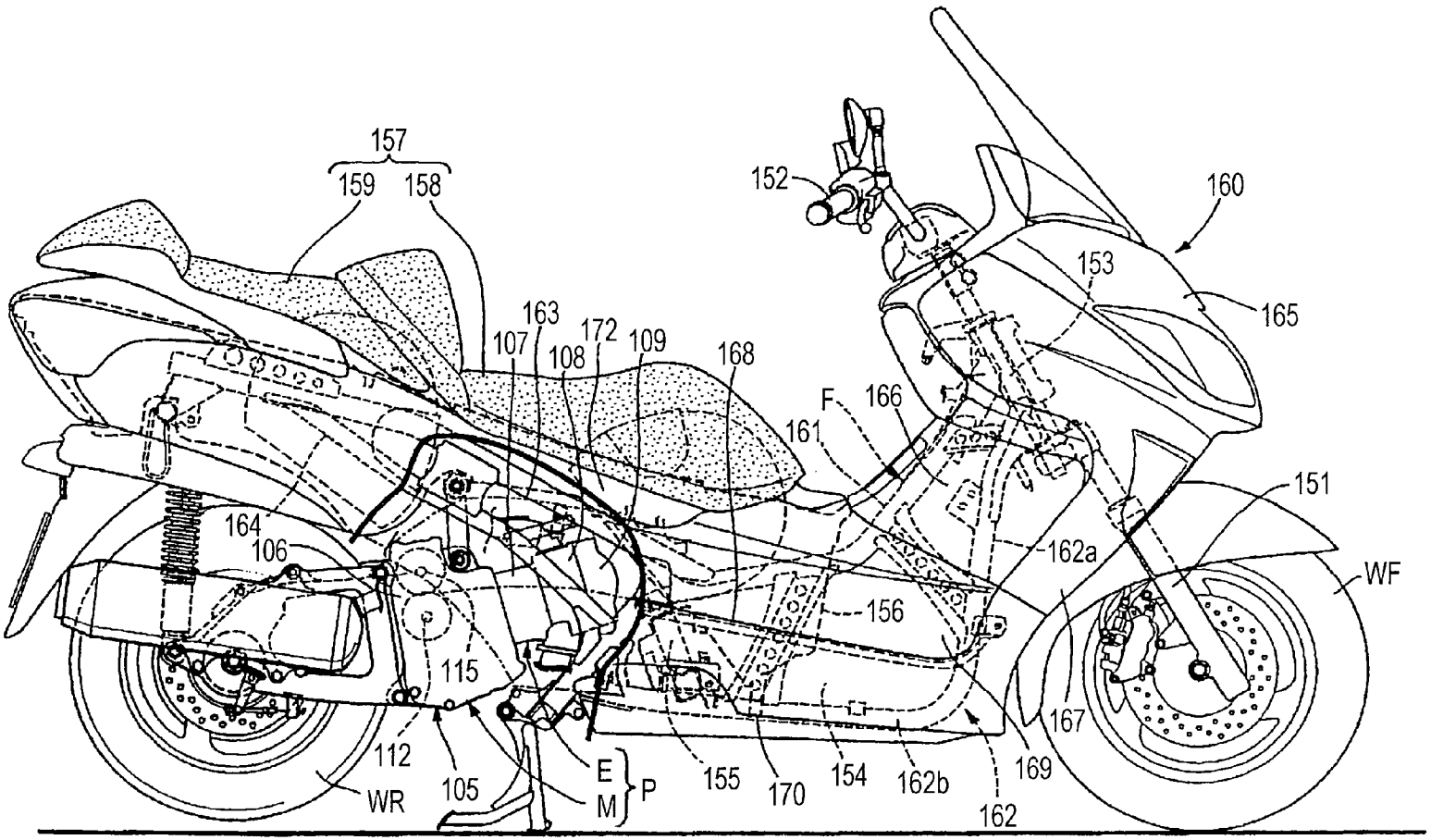
FIG. 6 is a side view showing a motorcycle.
Figure 7:
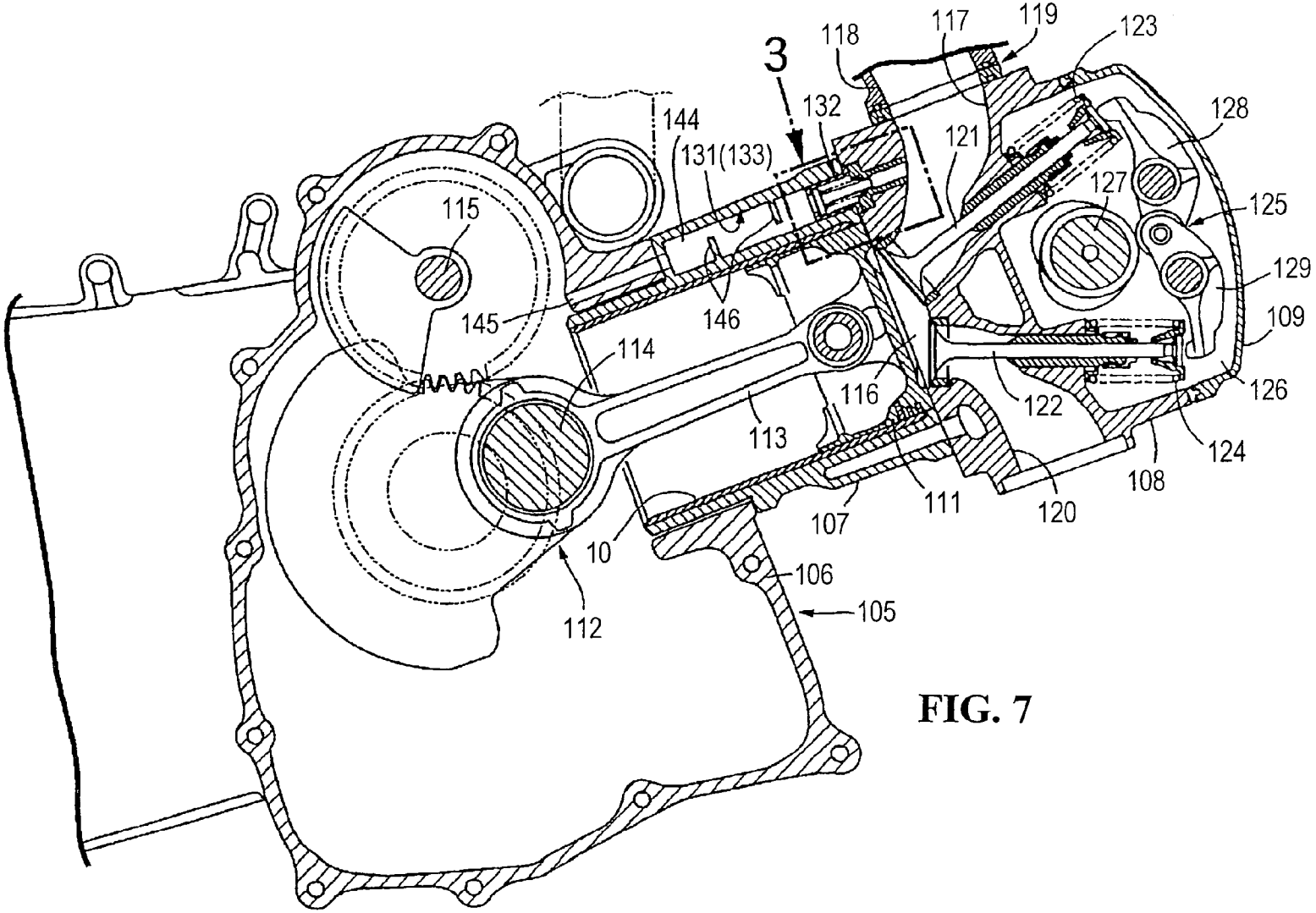
FIG. 7 is a longitudinal section showing a main part of an internal combustion engine.
Figure 8:
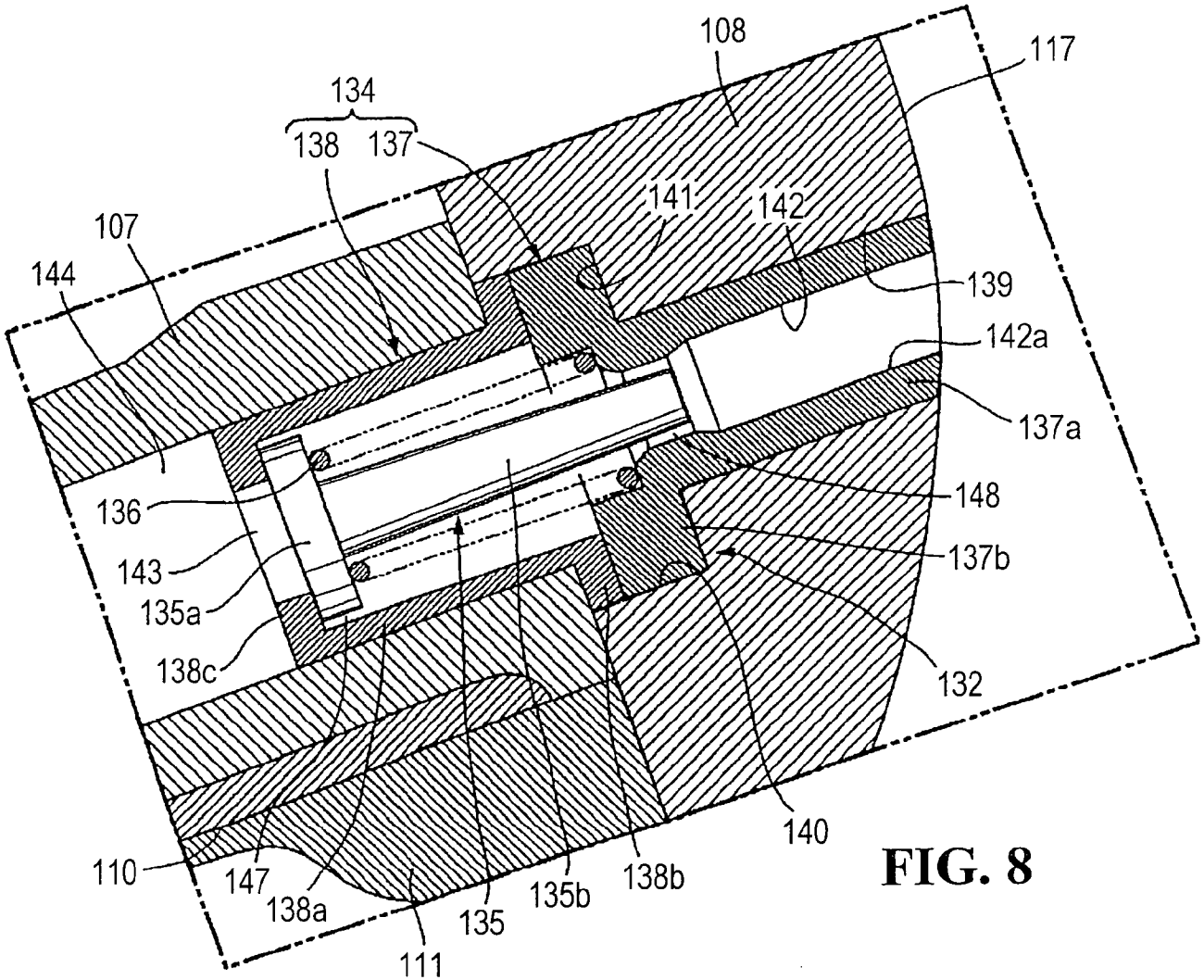
FIG. 8 is an enlarged view showing a part shown by an arrow 3 in FIG. 7.

FIGS. 6 to 8 show another embodiment of the invention. As illustrated in FIG. 6, a body frame F of a scooter-type motorcycle is provided with a front fork 151 that supports a front wheel WF and a head pipe 153 that supports a steering handlebar 152 coupled to the front fork 151 so that the steering handlebar can be steered at the front end. A power unit P that includes the internal combustion engine E and a transmission M and supports a rear wheel WR at the rear end is supported by an intermediate part in a longitudinal direction of the body frame F so that the power unit can be vertically rocked. A fuel tank 154 formed vertically longer in a side view and a radiator 155 arranged at the back of the fuel tank 154 are mounted on the body frame F in front of the power unit P. A housing box 156 is also attached to the body frame F so that the housing box covers the power unit P from the upside. A riding seat 157 is provided with a front seat 158 and a rear seat 159 and is formed in a tandem type and arranged on the upside of the housing box 156. Further, a body cover 160 made of synthetic resin that covers the body frame F, the front of the power unit P, the fuel tank 154, the radiator 155 and the housing box 156 is attached to the body frame F.

The body frame F is provided with the head pipe 153 with a pair of right and left upper down frames 161 coupled to the head pipe 153 that extend backward and downward. A pair of right and left lower down frames 162 with horizontal parts 162*b* that are integrated with respective rear ends of the inclined parts 162*a* are coupled to the head pipe 153 on the downsides of the upper down frames 161 and extend backward and downward with respective rear ends being welded to respective rear ends of the upper down frames 161. A pair of right and left seat rails 163 extend backward and upward from respective intermediate parts of both upper down frames 161 with a pair of right and left rear frames 164 that are coupled to the respective rears of the upper down frames 161 and the respective rears of the seat rails 163.

The body cover 160 is provided with a front cover 165 that covers the front of the head pipe 153 and the upside of the front wheel WF. A pair of right and left front side covers 166 are bonded to both right and left sides of the front cover 165 with leg shields 167 that cover the fronts of legs of a rider who sits on the front seat 158 and are bonded to both front side covers 166 so that the leg shields cover the head pipe 153 from the back. A pair of right and left floor center covers 169, that range to the leg shields 167, extend backward and form step floors 168 at respective lower ends. A pair of right and left floor side covers 170, that hang downward from respective outside edges of the step floors 168 and a pair of right and left body side covers 172, are arranged on the downsides of both sides of the riding seat 157, coupled to the floor side covers 170 and extend backward.

As shown in FIG. 7, a body 105 of the internal combustion engine E is provided with a crankcase 106, a cylinder block 107 connected to the crankcase 106, a cylinder head 108 connected to the cylinder block 107 and a head cover 109 connected to the cylinder head 108. A cylinder bore 110 having an axis inclined forward and upward in a state in which it is mounted in the motorcycle is provided to the cylinder block 107 and a piston 111 is slidably fitted into the cylinder bore 10.

A crankshaft 112 is supported by the crankcase 106 so that the crankshaft can be rotated and the piston 111 is coupled to the crankshaft 112 via a connecting rod 113 and a crankpin 114. A balance shaft 115, rotated by motive power transmitted from the crankshaft 112, is supported by the crankcase 106 on the upside of the crankshaft 112 so that the balance shaft can be rotated on an axis parallel to the crankshaft 112.

A combustion chamber 116, opposite to the top of the piston 111, is formed between the cylinder block 107 and the cylinder head 108 with an intake port 117 open to the side of an upper part of the cylinder head 108 being provided to the cylinder head 108 so that the intake port can communicate with the combustion chamber 116. An intake pipe 118, forming a part of an intake system 119 together with the intake port 117, is connected to the intake port 117. An exhaust port 120 open to the side of a lower part of the cylinder head 108 is provided to the cylinder head 108 so that the exhaust port can communicate with the combustion chamber 116.

An intake valve 121 that controls the inflow of air-fuel mixture from the intake port 117 to the combustion chamber 116 and an exhaust valve 122 that controls the outflow of exhaust gas from the combustion chamber 116 to the exhaust port 120 are arranged in the cylinder head 108 so that the intake valve and the exhaust valve can be opened and closed, and the intake valve 121 and the exhaust valve 122 are pressed in directions in which the valves are closed by respective valve springs 123, 124.

A valve system chamber 126 that houses a valve system 125 for opening and closing the intake valve 121 and the exhaust valve 122 is formed between the cylinder head 108 and the head cover 109. The valve system 125 is provided with a cam shaft 127 arranged between the intake valve 121 and the exhaust valve 122 so that the rotational motive power of the crankshaft 112 is transmitted from the crankshaft 112 at the speed reducing ratio of ±2. A rocker arm on the intake side 128 one end of which is synchronized and coupled with/to the intake valve 121 and is rocked according to the rotation of the cam shaft 127. A rocker arm on the exhaust side 129 one end of which is synchronized and coupled with/to the exhaust valve 122 and is rocked according to the rotation of the cam shaft 127.

A part of the exhaust gas combusted in the combustion chamber 116 leaks out to the side of crankcase 106 via a clearance between an inner face of the cylinder bore 110 and the piston 111 as blowby gas and the blowby gas is circulated to the side of an intake system 119. Fresh air from the intake system 119 is taken into the crankcase 106 via a path not shown.

The crankcase 106 is connected to the intake system 119 via a blowby gas passage 131 and on the way of the blowby gas passage 131, a flow control valve 132 that allows only a flow to the side of the intake system 119 is provided. According to the invention, a passage 133 at least a part of which reaches the cylinder head 108 via the cylinder block 107 from the crankcase 106 is directly provided in the crankcase 106, the cylinder block 107 and the cylinder head 108 respectively of the body 105 of the engine so that the part forms at least a part of the blowby gas passage 131 and in this embodiment, the passage 133 forms the whole blowby gas passage 131.

In addition, the flow control valve 132 is arranged in the cylinder block 107 or the cylinder head 108 on the way to the passage 133 and in this embodiment, the flow control valve 132 is arranged in the cylinder head 108 so that its outlet 142*a* is directly open to the intake port 117.

As shown in FIG. 8, the flow control valve 132 is configured by a valve case 134, a valve element 135 housed in the valve case 134 and a valve spring 136 compressed between the valve case 134 and the valve element 135.

The valve case 134 is configured by a first case half 137 fitted to the cylinder head 108 and a second case half 138 attached to the first case half 137 from the reverse side to the cylinder head 108. The cylinder head 108 is provided with a small-diameter fitting hole 139 one end of which is open to the side of the intake port 117 and a large-diameter fitting hole 140 which is formed in a larger diameter than the small-diameter fitting hole 139, one end of which coaxially ranges to the other end of the small-diameter fitting hole 140 and the other end of which is open to a face connected to the cylinder block 107 of the cylinder head 108. An annular stage 141 opposite to the cylinder block 107 is formed between the small-diameter fitting hole 139 and the large-diameter fitting hole 140.

The first case half 137 is integrally provided with an cylindrical part 137*a* one end of which is opposite to the intake port 117 and which is fitted into the small-diameter fitting hole 139 and a flange part 137*b* which is fitted into the large-diameter fitting hole 140 with the flange part touched to the annular stage 141 and which projects outside in a radial direction from the other end of the cylindrical part 137*a*. The second case half 138 is integrally provided with a cylindrical part 138*a* having a larger diameter than the cylindrical part 137*a* of the first case half 137. A flange part 138*b* projects outside in a radial direction from an open end of the cylindrical part 318*a* and an introrse flange part 138*c* projects inside in the radial direction from the other end of the cylindrical part 138*a*. When the flange part 137*b* of the first case half 137 and the flange part 318*b* of the second case half 38 are mutually touched, are fitted into the large-diameter fitting hole 140 and both flange parts 37*b*, 38*b* mutually touched are held between the annular stage 141 and the cylinder block 107 in connecting the cylinder head 108 and the cylinder block 107, the flow control valve 132 is arranged in the cylinder head 108.

In addition, a communicating passage on the outlet side 142 is provided to the first case half 137 in a state in which an outlet 142*a* at one end directly communicates with the intake port 117 and an inside face of the introrse flange part 138*c* of the second case half 138 forms a communicating hole on the inlet side 143 in the center of an end wall. The valve element 135 is configured by a disc like part 135*a* that can close the communicating hole on the inlet side 143 from its inside. A stem 135*b* is coaxially integrated with the center of the disc like part 135*a* and is inserted into the communicating passage on the outlet side 142. The stem 135*b* is formed so that it has a smaller diameter toward the end. Further, the valve coil spring 136 that surrounds the stem 135*b* presses the valve element 135 on the side on which the valve spring closes the communicating hole on the inlet side 143 in the disclike part 135*a* and is provided between the disclike part 135*a* and the first case half 137.

A vapor-liquid separating chamber 144, acquired by expanding the area of the passage is formed on the way of the passage 133 on the side of not the flow control valve 132 but the crankcase 106 in the cylinder block 107, in this embodiment, is provided along the whole length of the cylinder block 107 along the axis of the cylinder bore 110 in a state wherein the second case half 138, which is a part of the valve case 134 of the flow control valve 132, is inserted at the end on the side of the cylinder head 108. A passage hole 145 forming a part of the passage 133 is provided in the crankcase 106 so that the inside of the crankcase 106 communicates with the vapor-liquid separating chamber 144. In addition, in the cylinder block 107, a plurality of projections 146, 146 project inside from an inside face of the vapor-liquid separating chamber 144 and are provided so that blowby gas flows zigzag in the vapor-liquid separating chamber 144 so as to enhance the vapor-liquid separating performance.

The flow control valve 132 increases a degree of the reduction of the area of a first orifice 147 between the disc like part 135*a* and the second case half 138 by bringing the disc like part 135*a* of the valve element 135 close to the introrse flange part 138*c* when a negative pressure in the intake system 119 is low in the high intensity combustion of the internal combustion engine. This increases a degree of the reduction of the area of a second orifice 148 between the periphery of the stem 135*b* and the inside face of the communicating passage on the outlet side 142 by increasing the quantity in which the stem 135*b* of the valve element 135 is inserted into the communicating passage on the outlet side 142 when negative pressure in the intake system 119 is high in the low intensity combustion of the internal combustion engine for controlling a flow rate of blowby gas. Thus, a flow from the intake system 119 to the side of the crankcase 106 is obstructed.

Next, to explain the action of this embodiment, as the passage 133, at least a part of which reaches the cylinder head 108 from the crankcase 106 through the cylinder block 107 to form at least a part of the blowby gas passage 131, is directly provided to the crankcase 106, the cylinder block 107 and the cylinder head 108 and the flow control valve 132 is arranged in the cylinder block 107 or the cylinder head 108 on the way of the passage 133. The length of the blowby gas passage 131 from the crankcase 106 to the intake system 119 can be shortened and the temperature of blowby gas that flows in the blowby gas passage 131 is prevented from being lowered. Thus, the dew condensation can be inhibited. More particularly, as blowby gas that flows in the blowby gas passage 131 can easily receive heat generated in the body 105 of the engine, the effect of preventing dew condensation can be more enhanced.

More particularly, in this embodiment, as the flow control valve 312 is arranged in the cylinder head 108 in a state in which the outlet 142*a* is directly open to the intake port 117, the blowby gas passage 131 is connected to the intake port 117 by only connecting the blowby gas passage provided to the crankcase 106 and the cylinder block 107 to the flow control valve 132 mounted on the cylinder head 108. Thus, not only is the assembling work facilitated but a compact layout is enabled.

Further, as the vapor-liquid separating chamber 144 acquired by expanding the area of the passage is formed in the cylinder block 107 on the way of the passage on the side of not the flow control valve 132 but the crankcase 106, the separation of oil from the blowby gas can be accelerated in the vapor-liquid separating chamber 144 that receives heat from the cylinder block 107. Thus, vapor-liquid separation before blowby gas reaches the flow control valve 132 is enabled. In addition, as the flow control valve 132 is arranged in the cylinder head 108, the space for arranging the flow control valve 132 in the cylinder block 107 is not required to be secured and the volume of the vapor-liquid separating chamber 144 can be increased.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A crankcase including a lower part having an oil pan integrated with an internal combustion engine, comprising:

a crankcase cover having a portion extending laterally between right and left sides of the crankcase and covering a portion of the lower part of the crankcase in which the oil pan is provided; and a space provided between the lower part of the crankcase covered by the crankcase cover and the crankcase cover, said space providing a cooling fluid passage which is in communication with a cooling fluid which circulates to cool a cylinder or a cylinder head, the cooling fluid passage being connected to a radiator and the cooling fluid including water, and wherein at a lower part of the crankcase, the portion of the crankcase cover extending laterally between right and left sides of the engine extends laterally under at least a portion of the oil pan, and further comprising a thermostat for sensing a temperature of the cooling fluid circulating in the cooling fluid passage, wherein the thermostat controls the cooling fluid in the space to prevent diluting a lubricating oil in the oil pan during warming up of the engine, and controls the cooling fluid in the space to avoid an excessive rise of the temperature of the lubricating oil in the oil pan after warming up of the engine.

2. The crankcase for the internal combustion engine according to claim 1, wherein a cooling fluid pump is provided on a side of the crankcase to which the cooling fluid passage is provided.

3. The crankcase for the internal combustion engine according to claim 1, wherein blowby gas in the crankcase is prevented from being condensed into a dew in the crankcase by a warming of the crankcase by the lubricating oil for the crankcase.

4. A crankcase including a lower part having an oil pan integrated with an internal combustion engine, comprising:

a double wall structure formed around at least a portion of the lower part of the crankcase which extends laterally between right and left sides of the engine, so that the at least a portion of the lower part of the crankcase has double walls;

a space provided between the double walls, said space being in communication with a cooling fluid to provide a cooling fluid passage for making a cooling fluid circulate to cool a cylinder or a cylinder head, the cooling fluid passage being connected to a radiator and the cooling fluid including water; and wherein an inner one of the double walls forms the oil pan which extends between right and left crankcase halves of the engine, wherein an outer one of the double walls forms at least a crankcase cover, which extends under the oil pan and extends between right and left sides of the engine, and further comprising at least one partition plate being provided in the space, wherein the at least one partition plate causes the cooling fluid circulating in the cooling fluid passage to make a U-turn.

5. The crankcase for the internal combustion engine according to claim 1, wherein each of right and left sides of the crankcase includes a hole at a position above the oil pan, the holes for receiving a crankshaft which extends laterally between the right and left sides of the crankcase.

6. The crankcase for the internal combustion engine according to claim 1, further comprising a blowby gas passage extending between the crankcase and an intake port, wherein the blowby gas in the crankcase is prevented from being condensed into a dew in the crankcase by a warming of the crankcase by the lubricating oil.

7. The crankcase for the internal combustion engine according to claim 1, further comprising a cylinder block disposed between the crankcase and the cylinder head, and a blowby gas passage formed exclusively in the cylinder block, wherein the blowby gas passage extends between the crankcase and an intake port in the cylinder head, so that the blowby gas in the crankcase is prevented from being condensed into a dew in the crankcase by a warming of the crankcase by the lubricating oil.

8. The crankcase for the internal combustion engine according to claim 4, wherein each of the right and left crankcase halves includes a hole at a position above the oil pan, the holes for receiving a crankshaft which extends laterally between the right and left sides of the crankcase.

9. The crankcase for the internal combustion engine according to claim 4, further comprising a thermostat for sensing a temperature of the cooling fluid circulating in the cooling fluid passage, wherein the thermostat controls the cooling fluid to prevent diluting a lubricating oil in the oil pan, and to prevent an excessive rise of the temperature of the lubricating oil in the oil pan.

10. The crankcase for the internal combustion engine according to claim 4, further comprising a blowby gas passage extending between the crankcase and an intake port, wherein the blowby gas in the crankcase is prevented from being condensed into a dew in the crankcase by a warming of the crankcase by a lubricating oil.

11. The crankcase for the internal combustion engine according to claim 4, further comprising a cylinder block disposed between the crankcase and the cylinder head, and a blowby gas passage formed exclusively in the cylinder block, wherein the blowby gas passage extends between the crankcase and an intake port in the cylinder head, so that the blowby gas in the crankcase is prevented from being condensed into a dew in the crankcase by a warming of the crankcase by a lubricating oil.

* * * * *